US006000376A

United States Patent [19]

Hess et al.

[11] Patent Number: 6,000,376

[45] Date of Patent: Dec. 14, 1999

[54] METHOD AND DEVICE FOR CONTROLLING AND INTERNAL COMBUSTION ENGINE

[75] Inventors: Werner Hess, Stuttgart; Hong Zhang, Regensburg, both of Germany

[73] Assignee: Robert Bosch, Stuttgart, Germany

[21] Appl. No.: 08/983,090

[22] PCT Filed: Mar. 6, 1997

[86] PCT No.: PCT/DE97/00420

§ 371 Date: Jan. 12, 1998

§ 102(e) Date: Jan. 12, 1998

[87] PCT Pub. No.: WO97/43531

PCT Pub. Date: Nov. 20, 1997

[30] Foreign Application Priority Data

May 10, 1996 [DE] Germany ..... 196 18 893

[51] Int. Cl.[6] ..... F02D 41/34; F02P 5/15

[52] U.S. Cl. ..... 123/333; 123/339.16; 123/406.23; 123/436

[58] Field of Search ..... 123/436, 333, 123/339.16, 350, 352, 362, 406.23, 406.24, 406.25

[56] References Cited

U.S. PATENT DOCUMENTS

| | | | |
|---|---|---|---|
| 4,646,697 | 3/1987 | Grob et al. | 123/436 |
| 4,866,618 | 9/1989 | Tamura et al. | 364/431.03 |
| 5,245,966 | 9/1993 | Zhang et al. | 123/339 |
| 5,484,351 | 1/1996 | Zhang et al. | 477/113 |
| 5,558,178 | 9/1996 | Hess et al. | 180/197 |
| 5,623,906 | 4/1997 | Storhok | 123/419 |
| 5,657,230 | 8/1997 | Hess et al. | 364/431.052 |
| 5,676,111 | 10/1997 | Zhang | 123/325 |
| 5,676,112 | 10/1997 | Bauer et al. | 123/333 |
| 5,692,471 | 12/1997 | Ahang | 123/350 |
| 5,692,472 | 12/1997 | Bederna et al. | 123/350 |
| 5,832,897 | 11/1998 | Zhang | 123/352 |

FOREIGN PATENT DOCUMENTS

| | | |
|---|---|---|
| 2734024 | 11/1996 | France . |
| 4232973 | 4/1994 | Germany . |
| 4239711 | 6/1994 | Germany . |
| WO 9524550 | 9/1995 | WIPO . |

*Primary Examiner*—Tony M. Argenbright
*Assistant Examiner*—Arnold Castro
*Attorney, Agent, or Firm*—Walter Ottesen

[57] ABSTRACT

A method and an arrangement for controlling an internal combustion engine of a vehicle wherein a desired torque value is pregiven, this desired torque value being separated into at least two desired values. The desired values serve to adjust the charge of the internal combustion engine and at least one further power parameter, which effects a rapid torque change. The at least two desired values assume different values at least in one operating state.

10 Claims, 5 Drawing Sheets

METHOD AND DEVICE FOR CONTROLLING AND INTERNAL COMBUSTION ENGINE

FIELD OF THE INVENTION

The invention relates to a method and an arrangement for controlling an internal combustion engine.

BACKGROUND OF THE INVENTION

Such a method or an arrangement of this kind is known from DE-A 42 39 711. There, a desired value for a torque of the internal combustion engine is pregiven by the driver or, in special operating states, from other open-loop or closed-loop control systems. This desired value is, on the one hand, converted into a desired charging value and then into a desired value for controlling the air supply to the engine, for example, via a throttle flap and, on the other hand, into an ignition angle adjustment and/or a number of cylinders to which the metering of fuel is interrupted. The actual torque of the internal combustion engine approaches the pregiven desired torque value with this control of the power parameter of the engine.

In addition to the ignition angle adjustment and/or the suppression of injection to cylinders, it is known from WO-A 95/24550 to influence the mixture composition of the engine.

If a torque reduction for an engine is desired (for a corresponding input of the desired value), then the engine is, as a rule, adjusted with the desired dynamic because the engine torque can be immediately reduced by interventions, which act quickly on the torque. These interventions are interventions into the ignition angle, into the metering of fuel to the cylinders and/or into the mixture composition. The slower charge intervention is superposed for the torque reduction on this rapid torque change. However, if a torque increase is requested, then this can be carried out only via an increase in charge if: all cylinders are fired, the mixture composition is stoichiometric and the ignition angle is not shifted toward retard. The dynamic of this charge increase is however limited by the dynamic of the throttle flap actuator and/or the intake manifold dynamic.

SUMMARY OF THE INVENTION

It is an object of the invention to optimize the dynamic of the control of the torque of an engine at least in some operating states.

The dynamic of the torque change, especially for a torque increase, is optimized. It is especially advantageous that also in such operating states, the actual torque of the engine essentially follows the desired torque with the requested dynamic.

The solution according to the invention is especially advantageous in operating states wherein the torque change, especially the torque build-up, is already known in advance. This applies, for example, to a torque change: by the driver via pedal actuation, for interventions of a drive-slip controller or an engine drag torque controller, of a driving dynamic controller or like control system when loads are applied such as a climate control, in the case of a start and/or during warm-running in combination with catalytic converter heating measures. In these operating states, the torque change is undertaken correctly dynamically by the separation of the torque desired value into a desired value for the charge path and a desired value for the rapid interventions which can assume different values.

It is especially advantageous that the operating point of the engine can be shifted by the formation of so-called reserve torques so that all torque commands can be realized with the requested dynamic.

It is especially advantageous that, with the introduction of suitable limits, it is ensured that the requested torque can actually be realized especially in the charge path.

BRIEF DESCRIPTION OF THE DRAWINGS

The invention will be explained with reference to the drawings wherein.

DESCRIPTION OF THE PREFERRED EMBODIMENTS OF THE INVENTION

Figure 1:
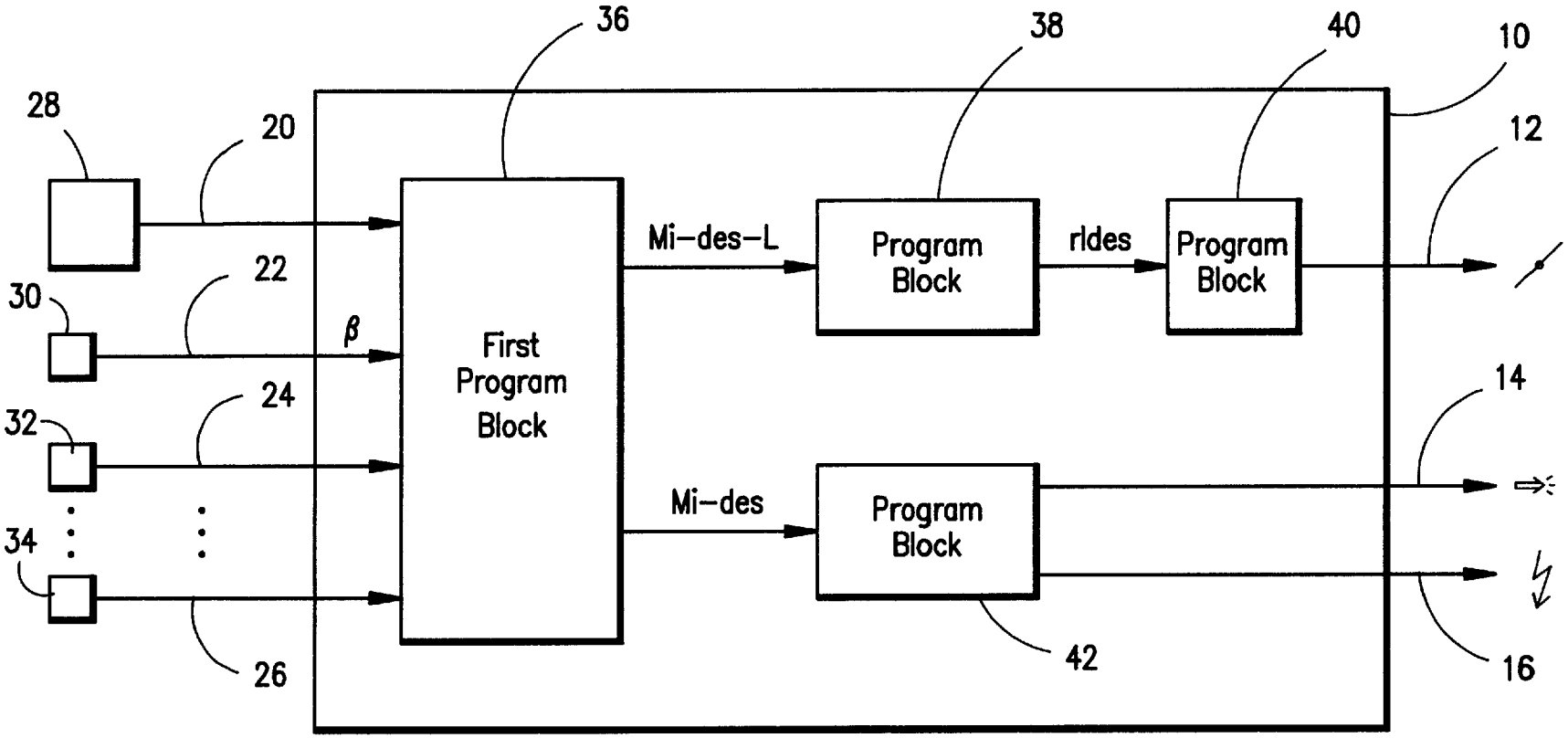
FIG. 1 shows the structure of the torque control of the invention with respect to an overview block circuit diagram.

In FIG. 1, an electronic control unit 10 is shown for controlling the torque of an internal combustion engine. The control unit 10 has at least one microcomputer (not shown). The programs implemented in the microcomputer are shown as blocks in FIG. 3. The control unit influences the air supply to the engine, the fuel metered (suppression and/or mixture composition) and the ignition angle of the engine via respective output lines 12, 14 and 16. The operating variables, which are processed for torque control, are supplied to the control unit 10 via input lines 20, 22 and 24 to 26. A desired value for a torque is supplied to the control unit 10 from at least one further control unit 28, for example, a drive-slip control unit. A signal representing the degree of actuation $\beta$ is supplied to the control unit 10 via the input line 22 from a measuring device 30 for detecting the accelerator pedal actuation. Furthermore, signals are supplied to the control unit 10 from measuring devices 32 to 34 via the input lines 24 to 26. These signals represent additional operating variables of the engine and/or of the vehicle such as engine speed, engine load, engine temperature, et cetera.

The operating variables, which are supplied to the control unit 10, are separated in a first program block 36 into a desired torque value $MI_{des-L}$ for the charge path and into a desired value $MI_{des}$ for influencing the metering of fuel and/or the ignition angle in a manner described below. Selected operating variables, or variables derived therefrom, are supplied to the control unit 10 via the lines 24 to 26. The torque desired value $MI_{des-L}$ for the charge path is, while considering the selected variables, converted in a next-following program block 38 into a charging desired value $rl_{des}$ in a manner known from the state of the art referred to initially herein. This charge desired value is converted in program block 40 into a drive signal for an electrically actuable throttle flap to adjust the air supply, as described in the state of the art initially referred to herein in the context of control loops. The charge of the engine is therefore adjusted in such a manner that it approaches the desired value and therefore the actual torque approaches the desired torque value. Parallel hereto, the torque desired value $MI_{des}$ is converted in program block 42 into drive signals for the rapid torque intervention in the known manner. These drive signals are for the mixture supply (interruption of fuel to cylinders and/or adjustment of the mixture composition) and/or for ignition angle adjustment. The signals are outputted via the symbolically shown lines 14 and 16.

The basic idea of the invention is that a torque desired value, which is present, is separated into a desired value for the charge path and the ignition angle path. In at least one operating state, the two desired values exhibit different torque values and are realized parallel to each other by adjusting the charge or metered fuel and/or ignition angle. In a preferred embodiment, it is provided that the separation only takes place when the future value of the torque desired value is greater than the actual desired value, that is, for torque increases.

Figure 2:
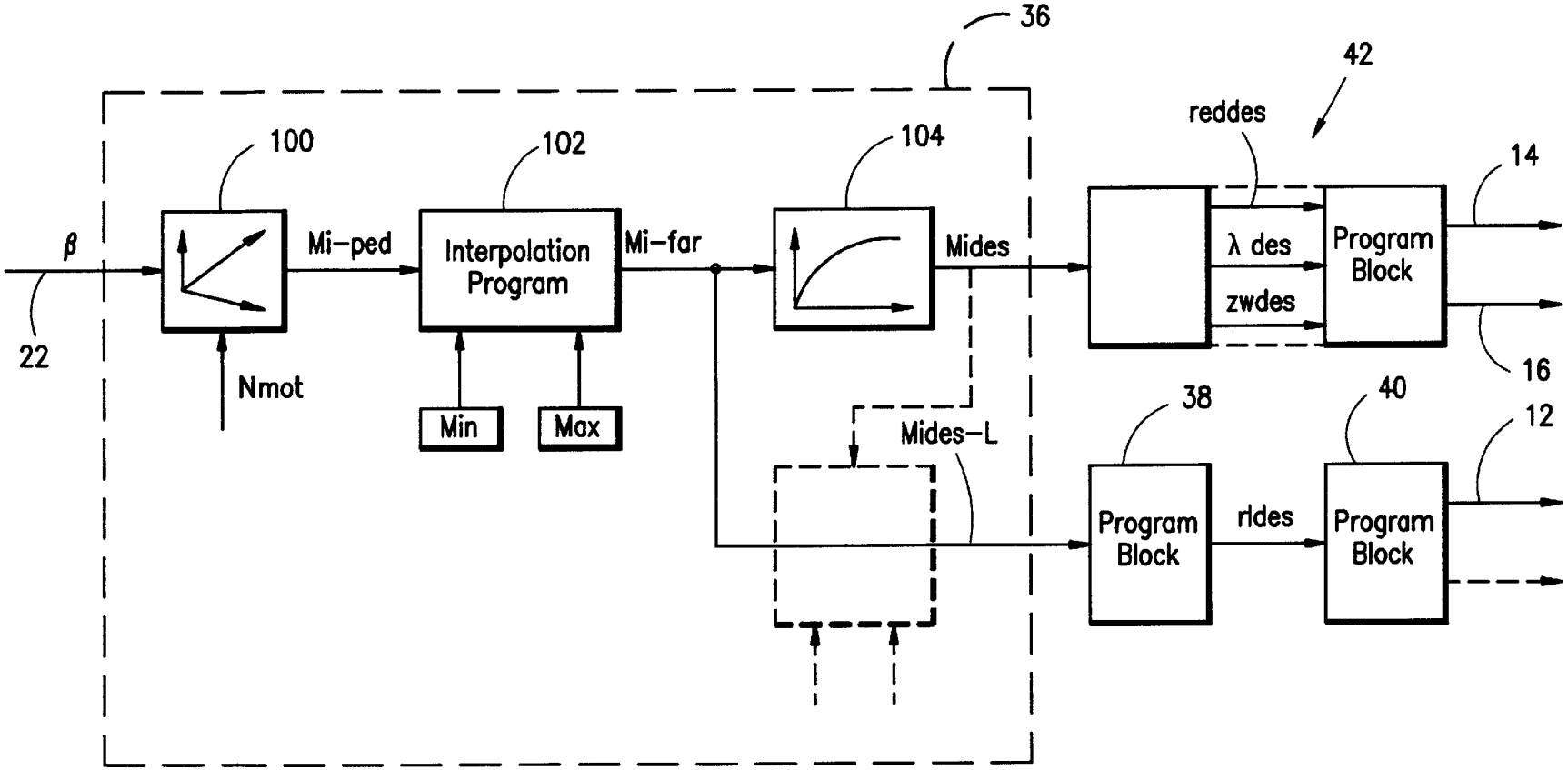
FIG. 2 is a block circuit diagram showing a first embodiment of the separation of the torque desired values.

FIG. 2 shows a first embodiment of the separation of the torque desired values. The solution shown is applied when the driver command, which is derived from the actuating signal β, changes in the direction of increasing torques. Here, it is assumed that only the driver command determines the desired torque and no further interventions (such as from a drive-slip control) are present.

In a first characteristic field 100, the torque $MI_{Ped}$, which is adjusted by the driver via the pedal actuation, is determined from the degree of actuation signal β and at least the engine rpm $N_{Mot}$. This pedal torque is interpolated in the next interpolation program 102 between a minimum torque value and a maximum torque value. These values are pregiven and are preferably at least dependent upon rpm. The driver command torque MIFAR, which is formed by the interpolation, is then filtered in the filter element 104 in accordance with a pregiven filter function (for example, lowpass first order). The filtered value in the described operating situation is viewed as desired torque $MI_{des}$ and is supplied to block 42 for determining the influence of the fuel metering and/or of the ignition angle. In a known manner, and from the supplied desired torque value, the block 42 computes desired values for the following: the number of cylinders ($RED_{des}$ to be suppressed, a desired value for the mixture composition λ-des and a desired value for the ignition angle adjustment ZWdes. These desired values are adjusted via the symbolic output lines 14 and 16.

In the steady state operating condition, that is, for a reduction of the torque, the filtered desired torque value $MI_{des}$ is, in a preferred embodiment, also the desired torque value, which is evaluated for determining the desired charge. If the driver changes the pedal position, however, in a manner which leads to a torque increase, the desired values, which are separated for charge path and rapid interventions, assume different values. In the embodiment of FIG. 2, the determination of the desired charge value is then not based on the filtered desired torque value but on the unfiltered desired torque value MIFAR. This desired torque value is supplied to the program block 38 for determining the desired charge $rl_{des}$ which, in turn, is converted in program block 40 into control signals for a throttle flap and, if required, for a turbo charger for influencing the cylinder charge.

In specific operating situations, the desired torque value is realized only by adjusting the charge and by adjusting the ignition angle for reasons of comfort and/or of exhaust gas. Here, it must be ensured that the desired value, which is pregiven by the driver or other open-loop or closed-loop control systems, is actually adjustable. For the particular operating point, the ignition angle is to be considered which can be the most retarded possible. This ignition angle is dependent upon operating variables, preferably on the engine rpm and the engine load and is stored in a characteristic field and is determined by the running limit of the engine. In this case and in accordance with the illustration shown in phantom in FIG. 2, the desired value, which is pregiven for the air path, is limited on the basis of the desired torque $MI_{des}$, which is to be adjusted, and at least the most retarded ignition angle. In this way, the torque change, which is pregiven by the driver, can be realized by adjusting the charge and rapidly adjusting the ignition angle. The actual torque is then rapidly guided to the desired torque.

Figure 3:
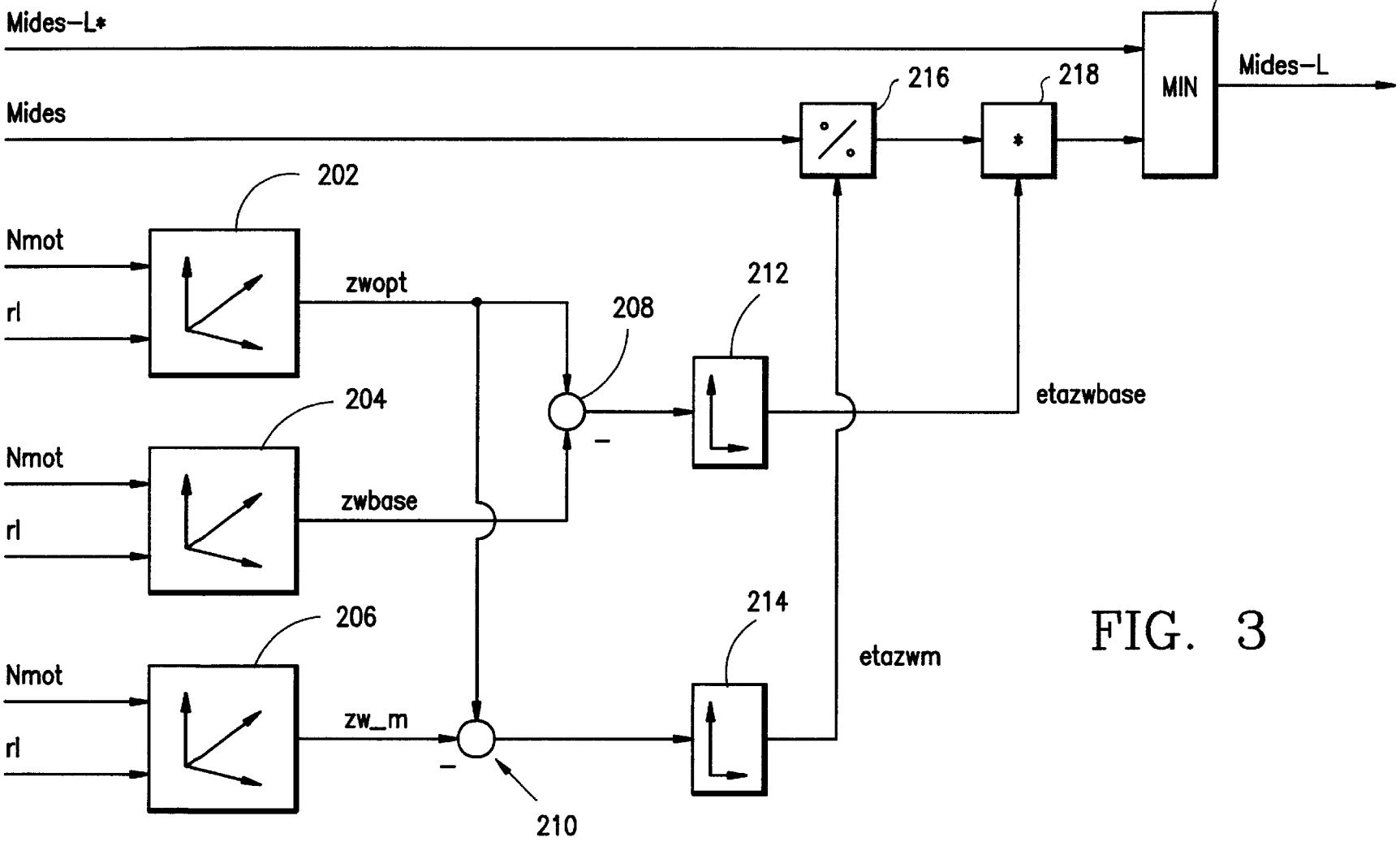
FIG. 3 is a block diagram for showing how the desired torque Mides-L is determined.

This limitation is shown in the block circuit diagram of FIG. 3. The desired torque for the air path $MI_{des-L}$ is determined on the basis of a minimum value selection 200 from the desired torque value $MI_{des}$, which is corrected in accordance with the ignition angle ratio, and a desired value $MI_{des-L^*}$, which is pregiven unlimited for the charge path.

There are three characteristic fields 202, 204 and 206 provided wherein the following is stored in dependence upon engine rpm and engine load: the optimal ignition angle $ZW_{opt}$ at which the engine exhibits the highest efficiency; the base ignition angle at the actual operating point $ZW_{base}$ which defines the ignition angle adjustment without external intervention (for example, by a drive-slip control); and, the ignition angle ZWM which is adjustable to be as retarded as possible at the actual operating point. The base ignition angle defines the ignition angle which is adjusted in the actual operating point of the engine without external intervention. In a first coupling element 208, the difference between the optimal ignition angle and the base ignition angle is formed; whereas, in a second coupling element 210, the difference between optimal and most retarded ignition angle is formed. The two difference values are converted into corrective torques (etazwbase, etazwm) in efficiency characteristic lines 212 and 214, respectively. These corrective torques define the efficiency change or the torque change which would occur when adjusting the particular ignition angle with the deviation to the optimal value.

The corrective values serve to correct the desired torque value $MI_{des}$. The ignition angle adjusted in the actual operating point is the base ignition angle. The largest torque change can be achieved by adjusting the most retarded ignition angle. The desired torque for the charge must therefore be limited downwardly to a pregiven minimum value in order to ensure that the desired torque can be realized by charge change and ignition angle adjustment. The corrected desired torque $MI_{des}$ defines this lower limit for the ignition angle intervention. The correction considers the most retarded adjustment of the ignition angle by division of the desired value by the efficiency etazwm (division element 216). The result defines the desired torque value when adjusting the most retarded ignition angle. Since the later conversion of the desired torque into a desired charge value takes place on the basis of the base ignition angle, the corrected desired torque value is multiplied in the multiplication element 218 by the efficiency of the base ignition angle in order to obtain the optimal torque to be adjusted.

The result is the desired torque value which can be adjusted by the largest possible ignition angle adjustment starting from the base ignition angle. The desired torque for the charge should not fall below this value because otherwise, the desired torque $MI_{des}$ cannot be realized. Therefore, a minimum value selection between the two values is carried out in the minimum value selection stage 200 and the lower desired value is supplied to the conversion into the desired charge value.

A second embodiment is the increase of the desired value for the charge path in specific operating situations which leads to an automatic shift of the ignition angle toward retard. These operating situations occur especially for active idle control, for active catalytic converter heating and/or during the start operation. These operating states have in common that a rapid adjustment of the torque must be possible in the direction of greater torques. A rapid adjustment is, however, only possible via the change of the following: the ignition angle, the fuel metered and/or the mixture composition. In the preferred embodiment, a so-called reserve torque is therefore adjusted in these operating states which is defined by an increase of the torque, which is adjusted via the charge, for a simultaneously oppositely directed change of the ignition angle, the fuel metering and/or the mixture composition. The total torque is not changed. In the preferred embodiment, only the ignition angle is considered.

It is here to be considered that the reserve torque can have different reference points. Especially, the reserve torque can be referred to the optimal torque (torque with the highest efficiency) or to the actually effective torque.

Figure 4:
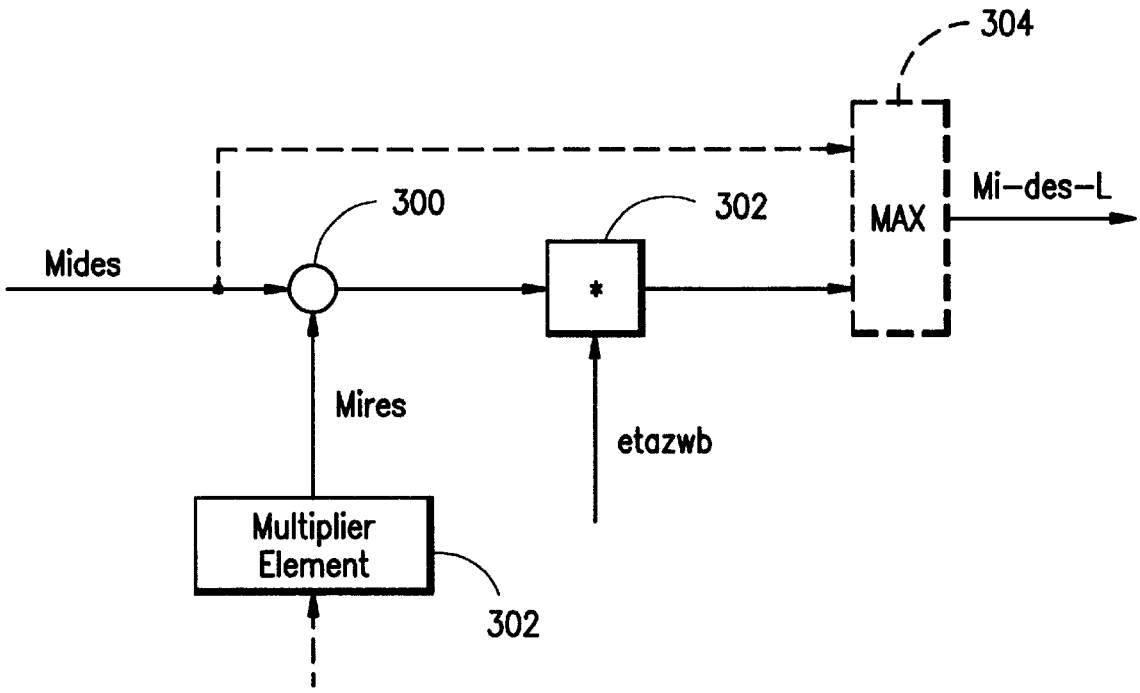
FIG. 4 is a block diagram of a first embodiment for the input in the charge path.

In FIG. 4, a first embodiment for the input in the charge path is shown which is applied especially via an idle control or for catalytic converter heating functions. The torque desired value $MI_{des}$ is pregiven by the driver or other open-loop or closed-loop control systems and serves to adjust the ignition angle as well as the additional power parameters which effect a rapid torque change. The torque desired value $MI_{des}$ is supplied to a coupling element 300. In this coupling element, the torque reserve value DMROPT, which is stored in the memory location 302, is added. The torque reserve is then either fixedly pregiven or is stored in a characteristic line in dependence upon operating variables. Operating variables are, for example, engine rpm, engine temperature, the equipment of the motor vehicle, the time after start, et cetera. The sum of torque desired value and torque reserve is multiplied in a multiplier element 302 by the base ignition angle efficiency, which is also the basis of the computation of the desired charge value. In the preferred embodiment, the result is compared in a maximum value selection stage 304 to the desired torque value $MI_{des}$ and the particular larger one of the two values is outputted as the desired torque for the air path $MI_{des-L}$.

In this embodiment, the reserve torque is referred to the optimal values (optimal torque, optimal ignition angle). In this way, a defined ignition angle is adjusted. The multiplication by the base ignition angle efficiency serves to consider the reference point for the conversion of the desired torque value for the charge path into a desired charge value.

Here too, a limiting of the desired torque value for the charge path is necessary. The limiting is to the maximum ignition angle. Assuming that the base ignition angle is the most advanced ignition angle (the ignition angle is optimal with respect to torque or on the knocking boundary), then it is ensured via the maximum value selection that too little charge is never pregiven. If the torque is controlled additionally via mixture influencing and/or cylinder inhibiting, this limiting is not needed.

Figure 5:
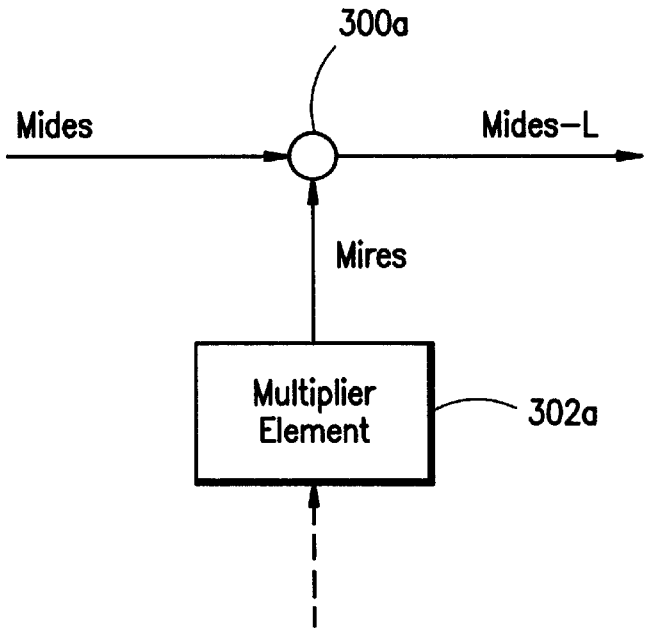
FIG. 5 is a block diagram wherein the torque desired value for the charge path results by addition of the torque desired values Mides for the rapid intervention and of the reserve torque DMR; and, FIG. 6*a* is a time-dependent trace of the desired torque Mides.

If the torque reserve value is referred to the instantaneously effective torque, then this limiting can be omitted and there results the significantly simpler structure of FIG. 5. In this case, the torque desired value for the charge path results by addition of the torque desired value $MI_{des}$ for the rapid intervention and of the reserve torque DMR.

The rapid intervention is adjusted in correspondence to the desired torque value $MI_{des}$ in the embodiments of FIGS. 4 and 5.

Figure 6A:
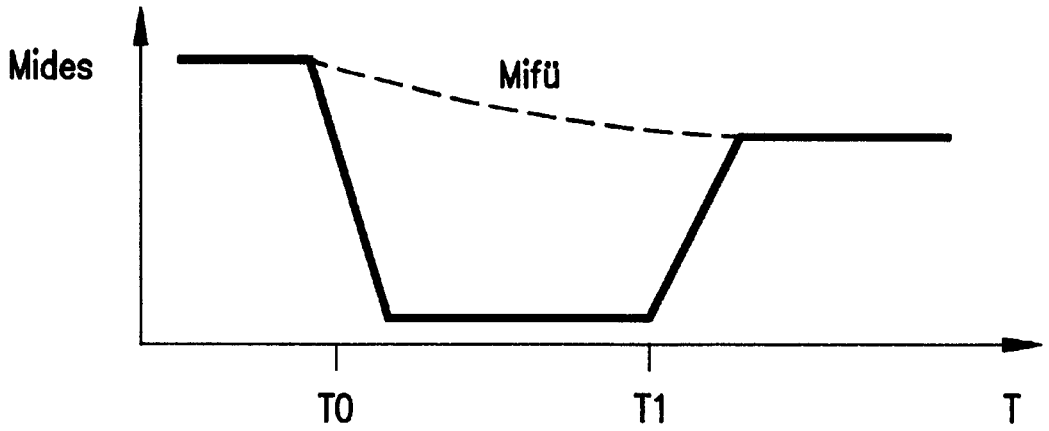
FIG. 6*b* is a time-dependent trace of the torque contribution MiZw by the ignition angle adjustment; and, FIG. 6*c* is a time-dependent trace of the actual torque Miact.
Figure 6B:
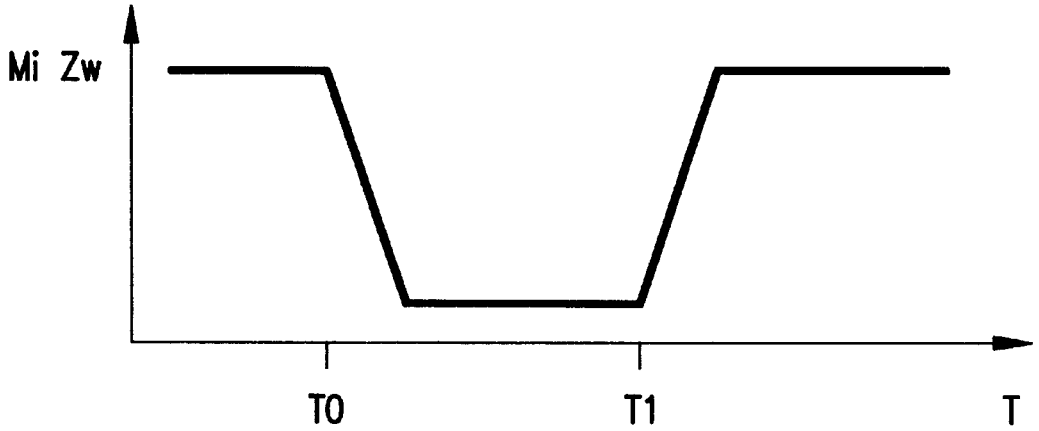
Figure 6C:
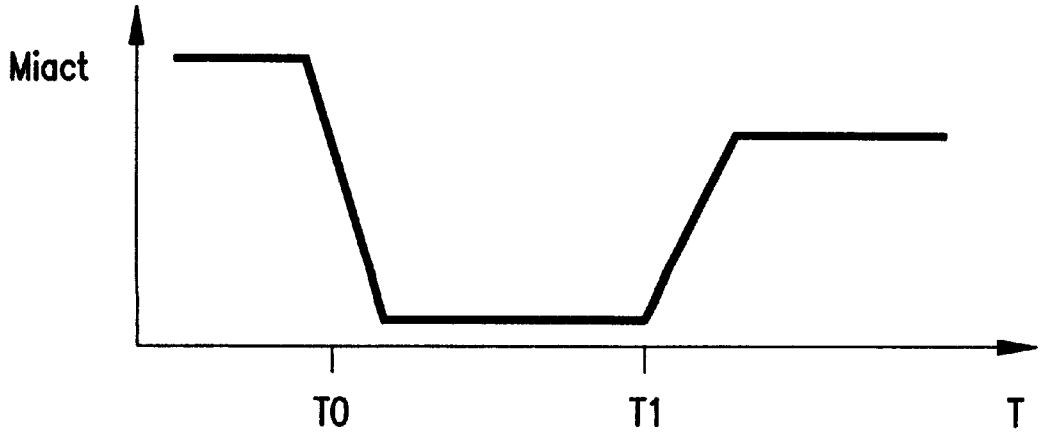

The effect of the solution of the invention and especially in accordance with the first embodiment, is shown in the example of FIG. 6. In FIG. 6*a*, the time-dependent trace of the desired torque value $MI_{des}$ as well as the torque contribution by the charge (broken line) is shown. In FIG. 6*b*, the time-dependent trace of the torque contribution by the ignition angle adjustment is shown and, in FIG. 6*c*, the time-dependent trace of the actual torque is shown.

The desired torque is reduced at time point T0. The desired torque value is realized by a shift of the ignition angle and by an adjustment of the charge. The charge component drops off only slowly as a consequence of the more rapid ignition angle shift (see FIG. 6*b*). The actual torque changes in accordance with FIG. 4*c* in correspondence to the desired value. The desired torque is again increased at time point T1. This torque increase is substantially carried out by the correction of the ignition angle according to the separation of the invention between charge path and ignition angle path. The advantageous effect is that the actual torque follows the desired value almost exactly also in the torque increasing direction.

In addition to a computation on the basis of torque values, in an advantageous embodiment, the computations are carried out on the basis of power values. Torque and power are interrelated via the engine rpm.

In lieu of the ignition angle adjustment, and in another advantageous embodiment, the mixture composition or the metering of fuel to a cylinder or a desired combination of these three variables is used.

What is claimed is:

1. A method for controlling an internal combustion engine of a vehicle, the method comprising the steps of:

pregiving a first desired value (Mi–des) for the torque of said engine;

controlling at least one operating variable of said engine in dependence upon said first desired value (Mi–des) with said operating variable effecting a rapid torque change of said engine;

pregiving a second desired value (Mi–des–L) for the torque of said engine and adjusting a charge of said engine based on said second desired value (Mi–des–L); and, pregiving said first and second desired values so that they deviate from each other in at least one operating state of said engine.

2. The method of claim 1, wherein said operating variable effecting a rapid torque change of said engine is at least one of the ignition angle and fuel quantity supplied to said engine.

3. The method of claim 1, wherein the at least one operating state is an operating state wherein at least one of the following conditions is present: the torque or power is increased, an idle control is active, a catalytic converter heating is active and during the start phase.

4. The method of claim 1, wherein the desired value is used unfiltered for adjusting the charge and is used filtered to adjust the at least one power parameter, the desired value being derived from the actuating signal of an accelerator pedal.

5. The method of claim 1, wherein a limit of a desired value for the charge takes place based on the parameter, which is adjustable for the generation of a maximum torque change, and based on a desired value for this at least one parameter.

6. The method of claim 1, wherein the desired value for the charge path is the minimum of the unfiltered and filtered corrected driver command.

7. The method of claim 1, wherein a reserve value for the torque or the power is formed, which is combined with the desired value and forms the desired value for the charge path.

8. The method of claim 7, wherein reserve value is referred to the optimal value of said torque or power value or to the actual value of said torque or said power.

9. The method of claim 1, wherein the desired value for the charge path is the maximum of the desired value and the desired value which is corrected with the reserve value.

10. An arrangement for controlling an internal combustion engine of a vehicle, the arrangement comprising:

an electronic control apparatus functioning to determine a first desired value (Mi–des) for the torque of said engine and to form an output signal for at least one operating variable of said engine in dependence upon said first desired value (Mi–des); said operating variable effecting a rapid torque change of said engine;

said electronic control apparatus further functioning to:

determine a second desired value (Mi–des–L) for the torque of said engine;

forming an output signal based on said second desired value (Mi–des–L) for adjusting a charge of said engine; and, pregiving said first and second desired values so that they deviate from each other in at least one operating state of said engine.

* * * * *